US005232121A

United States Patent [19]

Goeppner

[11] Patent Number: 5,232,121

[45] Date of Patent: Aug. 3, 1993

[54] COLLAPSED BODY BEAD FOR IMPROVED SIDEWALL INTEGRITY OF METAL CAN PACKAGES

[75] Inventor: Ronald R. Goeppner, Clarendon Hills, Ill.

[73] Assignee: Crown Beverage Packaging, Inc., Philadelphia, Pa.

[21] Appl. No.: 888,886

[22] Filed: May 26, 1992

Related U.S. Application Data

[60] Division of Ser. No. 817,949, Jan. 3, 1992, Pat. No. 5,137,171, which is a continuation of Ser. No. 79,403, Jul. 30, 1987, abandoned.

[51] Int. Cl.[5] ..... B65D 1/40

[52] U.S. Cl. ..... 220/667; 220/672; 53/486; 413/75

[58] Field of Search ..... 220/667, 669, 670, 672, 220/906; 53/486; 413/75

[56] References Cited

U.S. PATENT DOCUMENTS

| | | | |
|---|---|---|---|
| 1,730,434 | 10/1929 | Mauser | 220/72 |
| 2,414,781 | 1/1947 | Wacker | 220/667 |
| 3,099,069 | 7/1963 | Pugh et al. | 53/486 X |
| 3,117,873 | 1/1964 | Bartels et al. | 220/72 X |
| 3,819,083 | 6/1974 | Holk, Jr. | 220/906 X |
| 4,921,116 | 5/1990 | Troughton | 220/672 |
| 5,137,171 | 8/1992 | Goeppner | 220/667 |

FOREIGN PATENT DOCUMENTS

| | | |
|---|---|---|
| B20440/83 | 10/1983 | Australia . |
| 0108462 | 5/1984 | European Pat. Off. . |

*Primary Examiner*—Steven M. Pollard

*Attorney, Agent, or Firm*—Woodcock Washburn Kurtz Mackiewicz & Norris

[57] ABSTRACT

A can body which is reinforced by collapsed radially inwardly directed beads. The beads may either be normal to the axis of the can body or slope at an angle thereto. Maximum axial strength is obtained when the beads are normal to the axis of the can body while maximum panel strength is obtained when the beads slope at an angle to the axis. The can body is provided with normal open beads which are collapsed either during a flanging operation or a double seaming operation. When the beads slope relative to the axis of the can body, it is necessary that the originally formed open beads have a configuration which will permit the collapsing of the beads while the beads remain in angular relation with respect to the axis of the can body.

7 Claims, 1 Drawing Sheet

COLLAPSED BODY BEAD FOR IMPROVED SIDEWALL INTEGRITY OF METAL CAN PACKAGES

This is a division, of application Ser. No. 817,949, filed Jan. 3, 1992, now U.S. Pat. No. 5,137,171 which is a continuation of application Ser. No. 079,403, filed Jul. 30, 1987 (now abandoned).

This invention relates in general to new and useful improvements in metal cans and more particularly to the provision of collapsed body beads for improving the sidewall integrity of such cans.

It is customary to provide metal can bodies with generally semicircular cross sectional beads for the purpose of imparting paneling or sidewall strength to the can body. However, because the beads are not axially stable, the resultant beaded can body does not have the axial strength of a straight sided can body.

In accordance with the disclosure of Bartels et al, U.S. Pat. No. 3,117,873, a can body is provided with a conventional bead near the upper end thereof and after the can body has been vacuum packed with a certain axial collapsing of the bead due to the vacuum within the can, an axial force is placed on the can so as to further collapse the bead whereby all cans so packed will be of the same height. Thus, while there is a collapsing of the bead, the bead is not collapsed for the purpose of increasing paneling or sidewall strength nor is the bead necessarily fully collapsed so that the can body has the same axial strength as a straight sided can body.

In accordance with this invention, it is proposed to provide a conventional can body with one or more internal beads and thereafter collapse the beads so as to substantially close the beads and thus provide a can body having the axial strength of a straight sided can body while having a material increase in paneling or sideways strength.

One of the features of the invention is that the collapsing of the beads may be effected during another operation so as not to require a separate operation to effect the bead collapsing. Such other operation may include flanging of the can body or within a closure machine during a double seaming operation either when putting one end on a three piece can or during the final closing of the can after a product has been placed therein.

With the above and other objects in view that will hereinafter appear, the nature of the invention will be more clearly understood by reference to the following detailed description, the appended claims, and the several views illustrated in the accompanying drawings.

Figure 1:
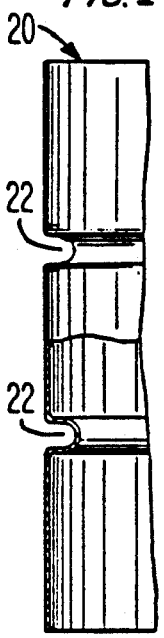
FIG. 1 is a fragmentary sectional view taken through a can body of a three piece can prior to flanging.

Referring now to the drawings in detail, it will be seen that there is illustrated in FIG. 1 a tubular can body for a three piece can, the can body being formed in accordance with this invention and being generally identified by the numeral 20. The can body 20, as formed, is provided with one or more open beads 22 which are radially inwardly directed.

In order that the can body 20 may receive end units by way of double seaming operations, it is necessary that the opposite ends of the can body 20 be flanged. Can bodies are conventionally flanged in a flanger wherein opposed flanging heads 24, 26 engage opposite ends of the can body 20 and apply axial pressure thereto as indicated by the arrows. Flanges 28, 30 are thus formed on the ends of the can body 20. At the same time, the beads 22 are automatically collapsed.

It is to be understood that the can body 20, having been flanged and having the beads 22 thereof collapsed, has the same axial strength as a straight sided can body, i.e. a can body without beads, while at the same time the collapsed beads 22 greatly increase the panel or sidewall strength.

Figure 3:
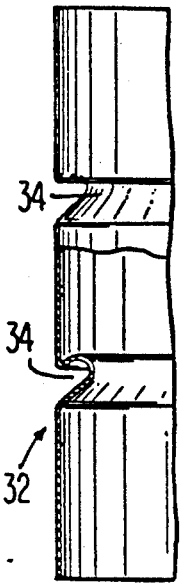
FIG. 3 is a fragmentary vertical sectional view similar to FIG. 1 and showing the modified bead formation.

Further, it has been found that if the beads 22, in their collapsed state, extend at an angle to the axis of the can body, a maximum panel strength may be obtained. Accordingly, reference is made to FIG. 3 wherein there is illustrated a modified version of the can body 20, the can body being identified by the numeral 32 and being provided with radially inwardly directed open beads 34. The beads 34, however, instead of being generally normal to the axis of the can body, slope upwardly, as is clearly shown in FIG. 3.

Figure 2:
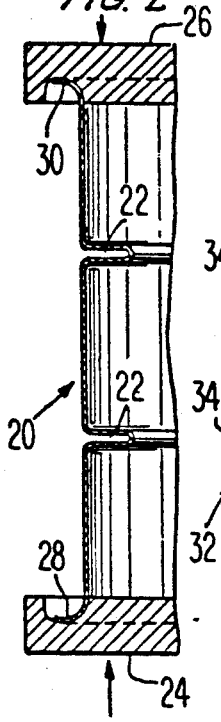
FIG. 2 is a fragmentary vertical sectional view similar to FIG. 1 and showing the can body being flanged and the beads being collapsed.

The can body 32 is part of a three piece can and must have the opposite ends thereof flanged as illustrated in FIG. 2. Accordingly, the can body 32 i s placed in a flanger and is engaged by the opposing heads 24, 26 thereof to form at opposite ends of the can body 32 flanges 36. In the forming of the flanges 36, the beads 34 are collapsed so as to be substantially flat. It has been found that with the beads 34 being disposed at an angle to the axis of the can body 32, the can body 32, even though otherwise it is of the same construction as the can body 20, has a greater panel strength.

Figure 5:
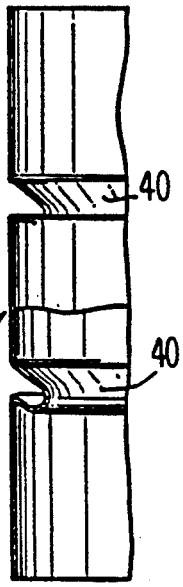
FIG. 5 is a fragmentary vertical sectional view similar to FIG. 1 showing another form of bead arrangement.

In FIG. 5 there is illustrated another form of can body, generally identified by the numeral 38. The can body 38, in fact, is identical to the can body 32 except that it is turned upside down and has sloping open beads 40 which slope downwardly as opposed to sloping upwardly.

As with the can bodies 20, 32, the can body 38 must be provided with flanges and this is done in a flanger including flanging heads 24, 26. The flanger applies to opposite ends of the can body 38 flanges 42 for receiving conventional end units in a double seaming operation.

Figure 7:
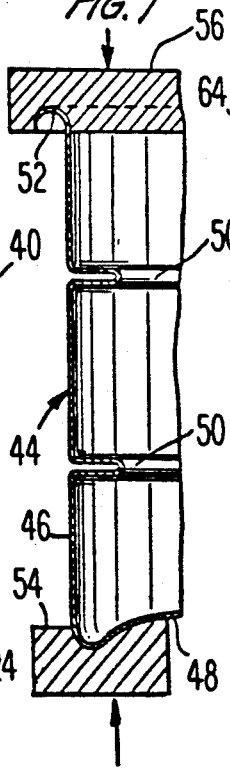
FIG. 7 is a fragmentary vertical sectional view similar to FIG. 2 but showing a two piece can being flanged and the beads being collapsed.

While the invention so far has been described and illustrated with respect to a can body for a three piece can, it is to be understood that the invention would apply equally as well to a can body for a two piece can. Accordingly, reference is made to FIG. 7 wherein such can body is illustrated and is designated by the reference numeral 44. The can body 44 is formed to have a tubular body 46 and an integral bottom 48. The body 46 is initially formed with open beads 50 and a square cut end. In order that a closing end unit may be applied to the can body 44, it is necessary that the square cut end be provided with a flange 52. This is accomplished by placing the can body 44 in a flanger which includes a support for the bottom end of the can body and a flanging head 56 which will correspond generally to the flanging head 26. The axial pressure applied to the can body 44 in the formation of the flange 52 is sufficient to collapse the beads 50 so that the beads 50 have the appearance shown in FIG. 7.

Figure 4:
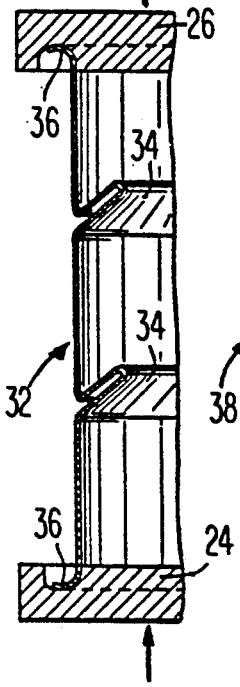
FIG. 4 is a fragmentary vertical sectional view similar to FIG. 2 and shows the flanging of the can body of FIG. 3 and the collapsing of the beads thereof.
Figure 6:
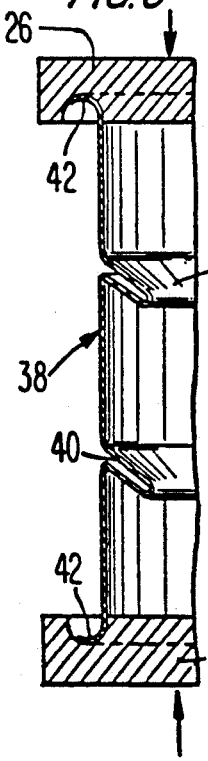
FIG. 6 is a fragmentary vertical sectional view similar to FIG. 2 and shows the can body of FIG. 5 being flanged.

At this time, it is to be understood that the beads 50 could be arranged in sloping arrangement to the axis of the can body 44 and either slope upwardly as shown in FIG. 4 or downwardly as shown in FIG. 6.

It is also feasible that the can body be provided with flanges in advance of the formation of the beads. Accordingly, reference is made to FIG. 8 wherein there is illustrated the can body 52. The can body 52 is of a cylindrical construction, but is initially provided with flanges 54 at opposite ends thereof. Subsequent to the flanging operation, the can body 52 is provided with open beads 56.

Since the can body 52 is part of a three piece can, it is necessary that one end thereof be closed prior to receiving a product. Such an end, identified by the numeral 58, is applied in a conventional double seaming operation wherein the can body 52 is carried by a support 60 and the end unit 58 is first engaged by a chuck 62 of the closure machine followed by the peripheral portion of the end unit being engaged by first and second seaming wheels to form a double seam 64 between the end unit and the can body 52. Only the second seaming wheel 66 is illustrated.

Figure 8:
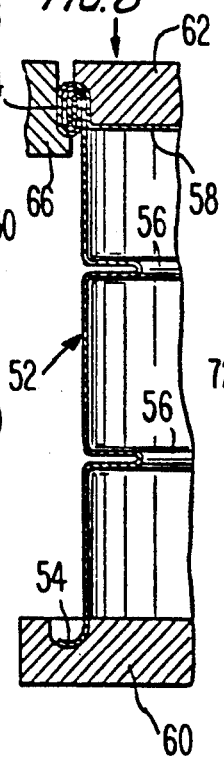
FIG. 8 is a fragmentary vertical sectional view showing one end of a can body similar to that shown in FIG. 1 having an end unit being applied thereto by double seaming operation and the beads being collapsed.

It is to be understood that in the formation of the double seam 64, sufficient axial pressure is applied to the can body 52 to effect the collapse of the beads 56 from their open state similar to the open beads 22 of FIG. 1 to their closed state of FIG. 8.

Once again, although only beads which extend normal to the axis of the can body have been specifically illustrated, it is to be understood that the can body 52 may be provided with beads which slope either upwardly or downwardly relative to the axis of the can body such as the beads 34 and 40.

Figure 9:
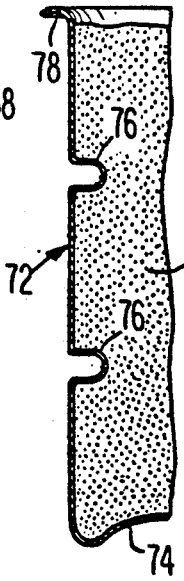
FIG. 9 is a fragmentary vertical sectional view taken through a two piece can provided with open beads and a flange and filled with a product.
Figure 10:
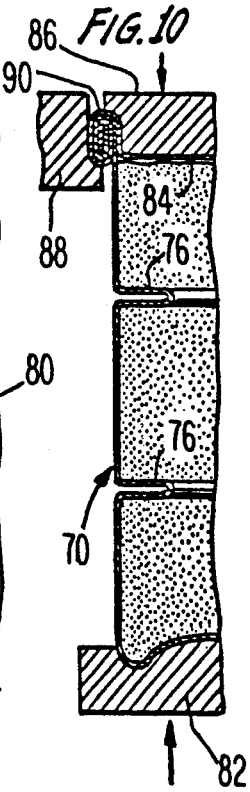
FIG. 10 is a fragmentary vertical sectional view similar to FIG. 9 showing the filled can of FIG. 9 being closed by a double seaming operation and the open beads being collapsed.

Reference is now made to FIGS. 9 and 10 wherein it is illustrated how a two piece can may have the beads thereof closed in a final closing operation after a product has been placed therein. In FIG. 9 there is illustrated a two piece can body generally identified by the numeral 70. The can body 70 includes a tubular body portion 72 having an integral bottom 74. The body portion 72 is provided with a pair of open beads 76 and the square cut end thereof remote from the bottom 74 has been flanged to provide a flange 78. The can body 70 is then filled with a product 80 to the desired height. Following this, the filled can body 70 is closed.

With reference to FIG. 10, it will be seen that the filled can body 70 is directed into a conventional closing machine wherein the filled can body 70 is carried by a suitable support 82 at the bottom thereof. A closing end unit 84 is seated on the flange 78 and then is engaged by a double seaming chuck 86. The periphery of the end unit 84 is engaged by first and second seaming wheels of which only the second seaming wheel 88 is illustrated. The seaming wheels roll the periphery of the end unit 84 and the flange 78 to form a double seam connection 90 between the end unit 84 and the can body 70.

It is to be understood that the endwise pressure applied to the can body 70 in the double seaming operation is sufficient to collapse the beads 76 as is shown in FIG. 10.

At this time it is pointed out that although the beads 76 have been illustrated as being disposed substantially normal to the axis of the can body 70, the beads could be disposed at an angle to the axis of the can body such as the beads 34 and 40 of FIGS. 4 and 6.

It is to be understood that from a structural standpoint it is immaterial as to whether the beads are collapsed by a flanging operation or in a double seaming operation.

Although only several embodiments of the beaded can body have been specifically illustrated and described herein, it is to be understood that minor variations may be made in the can body construction and the method of forming the same without departing from the spirit and scope of the invention as defined by the appended claims.

I claim:

1. A reinforced tubular can body produced by a method comprising the steps of providing a tubular can body having remote ends with a radially inwardly directed open bead remote from an adjacent one of said ends, and thereafter selectively during a flanging operation and a double seaming operation applying an axial pressure on said can body and collapsing said bead.

2. A reinforced tubular can body according to claim 1, wherein one end of said can body is open, and said collapsing of said bead occurs while said one end of said can body is open.

3. A reinforced tubular can body according to claim 2, wherein said collapsing of said bead occurs during flanging of said can body.

4. A reinforced tubular can body according to claim 2, wherein said collapsing of said bead occurs during double seaming of an end unit to said can body at an end of said can body remote from said open end.

5. A reinforced tubular can body according to claim 1, wherein there are at least two of said beads, and said beads are simultaneously collapsed.

6. A reinforced tubular can body according to claim 1, wherein a product is placed in said can body and the collapsing of said bead is effected during the final closing of said can body during the double seaming of a closing end unit.

7. A reinforced tubular can body according to claim 1, wherein said open bead is formed to a shape wherein when said bead is collapsed the bead will be sloping relative to the axial direction of said can body.

* * * * *

UNITED STATES PATENT AND TRADEMARK OFFICE

CERTIFICATE OF CORRECTION

PATENT NO. : 5,232,121

DATED : August 3, 1993

INVENTOR(S) : Ronald R. Goeppner

It is certified that error appears in the above-indentified patent and that said Letters Patent is hereby corrected as shown below:

Col. 2, line 50, after "32" delete "i s" and insert --is-- therefor.

Signed and Sealed this

Thirty-first Day of October 1995

*Attest:*

Bruce Lehman

BRUCE LEHMAN

*Attesting Officer*

*Commissioner of Patents and Trademarks*